US005544978A

United States Patent [19]

Albers

[11] Patent Number: 5,544,978

[45] Date of Patent: Aug. 13, 1996

[54] COMBINED AUGER AND THRUSTER MACHINE

[75] Inventor: Michael W. Albers, Ashland, Ohio

[73] Assignee: Bor-It Meg. Co., Inc., Ashland, Ohio

[21] Appl. No.: 276,433

[22] Filed: Jul. 18, 1994

[51] Int. Cl.[6] ..... E02D 7/00; E02D 17/02

[52] U.S. Cl. ..... 405/232; 173/184; 173/188; 175/171; 405/229; 405/244

[58] Field of Search ..... 405/232, 231, 405/303, 245–247; 175/162, 171; 173/193, 28, 124, 131, 133, 26, 24, 42, 44, 184, 186, 187, 188

[56] References Cited

U.S. PATENT DOCUMENTS

| | | | |
|---|---|---|---|
| 3,621,910 | 11/1971 | Sanford | 175/171 X |
| 3,864,923 | 2/1975 | Turzillo | 405/232 |
| 3,869,003 | 3/1975 | Yamada et al. | 405/232 |
| 4,296,821 | 10/1981 | Larson | 175/171 X |
| 4,809,788 | 3/1989 | Nelson | 173/42 X |
| 4,813,496 | 3/1989 | Robweller et al. | 175/171 X |
| 5,232,268 | 8/1993 | Dengler et al. | 173/184 X |
| 5,269,107 | 12/1993 | Klemm | 52/115 |

FOREIGN PATENT DOCUMENTS

| | | | |
|---|---|---|---|
| 794556 | 12/1935 | France | 405/232 |
| 2534292 | 4/1984 | France | 405/231 |
| 2060742 | 5/1981 | United Kingdom | 405/232 |

*Primary Examiner*—Dennis L. Taylor
*Attorney, Agent, or Firm*—Renner, Kenner, Greive, Bobak, Taylor & Weber

[57] ABSTRACT

A machine for simultaneously augering and thrusting an anchor into the ground for later attachment of a utility pole or road sign. A vehicle is used to transport the thruster machine with a hydraulic control system such that a rail track is moved into thrusting position and locked in place. A winch, plus a system of hydraulic pistons will raise and lower an auger and thrusting device into the position desired. With an anchor affixed to the bottom of a platform, the auger is then used to drill out the dirt and other material so that the anchor may be more easily inserted into the ground. The thrusting process is facilitated by an indexing feature contained within the platform. A series of hydraulic pistons drive the anchor into the ground until fully stroked, whereupon the platform is re-indexed as needed to completely sink the anchor. Furthermore, a counter-thrust device may also be employed to stabilize the vehicle during the thrusting operation. Upon completion of the thrusting process, the platform is disengaged from the anchor and raised to its starting position. The rail track is then lowered back onto the flatbed truck, and the vehicle can then be driven to the next desired location for sinking an anchor.

18 Claims, 5 Drawing Sheets

COMBINED AUGER AND THRUSTER MACHINE

TECHNICAL FIELD

The invention herein resides in the art of augering and setting anchors that are used to secure road signs, utility poles, lamp posts, and the like. In particular, the present invention provides a machine that simultaneously augers and thrusts an anchor into the ground for later use. Specifically, the invention resides in a machine that drives anchors for use with utility and sign poles or lamp posts from an easily maneuverable vehicle.

BACKGROUND ART

In the desire to get from one place to another people have sought to travel along roads and highways in a quick and easy manner. To facilitate transportation and commerce along these roads, governments and individuals have used road signs. Typically, these road signs have indicated the direction to take for proceeding to a particular location or in designating how far a certain location is from that particular point. In ancient times markers such as large rocks or distinctive geographic characteristics were used for the aforementioned purposes.

More recently, road signs were attached to posts that were sunk into the ground. To provide a proper road sign that was long lasting and could withstand elements such as ice, wind, and rain, a person would have to dig a deep hole, sink the post into the ground, and then refill the hole with concrete to secure the post therein. With the advent of the automobile and the modern highway large numbers of road signs, lamp posts, and utility poles were required. In order to facilitate this increased demand for signage, posts, and poles, thruster machines were developed to drive anchors into the ground so that appropriate poles could be attached thereto. Further, the use of this anchor-pole system allows the interchangeability of poles and road signs while utilizing the same anchor. While these machines were an improvement over hand digging the anchor holes, it was still found to be very difficult to displace the earth where the anchor was to be set. Furthermore, difficulties arose in that the anchors could not be reliably set so as to provide a level surface on which to erect a road sign, thus creating an unsafe condition. Additionally, deep anchors are required so that the poles may withstand wind, snow, rain, and other hazards.

Accordingly, there is a need in the art for an apparatus or machine that will simultaneously auger a hole and drive an anchor therein, so that appropriate poles for signs or the like can be attached thereto.

DISCLOSURE OF INVENTION

In light of the foregoing, it is a first aspect of the invention to provide a machine for auguring a hole while simultaneously setting an anchor therein.

It is another aspect of the present invention to provide such a machine that is mobile and easy to set up and operate.

It is yet another aspect of the present invention to provide such a machine that will simultaneously auger a hole and set an anchor therein and which is operated using hydraulic controls.

It is still another aspect of the present invention to provide a machine that augers holes and sets an anchor therein by electronically actuating the hydraulic controls.

It is a further aspect of the present invention to provide a machine that augers holes and sets an anchor therein that is safe, reliable, and provides a cost savings when compared to other methods of setting anchors, such as concrete platforms.

It is another aspect of the present invention to provide a means for sinking an anchor that is of a superior strength and durability when compared to other methods of sinking anchors.

At least one or more of the foregoing objects, together with the advantages thereof over the known art relating to sinking anchors, which shall become apparent from the specification which follows, are accomplished by the invention as hereinafter described and claimed.

The foregoing and other aspects of the invention which will become apparent as the detailed description proceeds are achieved by a combined auger and thruster machine, comprising: a thrust rail track maintainable in a stationary position; a platform moveable upon said track, said platform adapted to receive and drive an anchor, said anchor having an axial bore; and an auger carried by said platform and passing through said axial bore when said anchor is received by said platform.

BEST MODE FOR CARRYING OUT THE INVENTION

Figure 1:
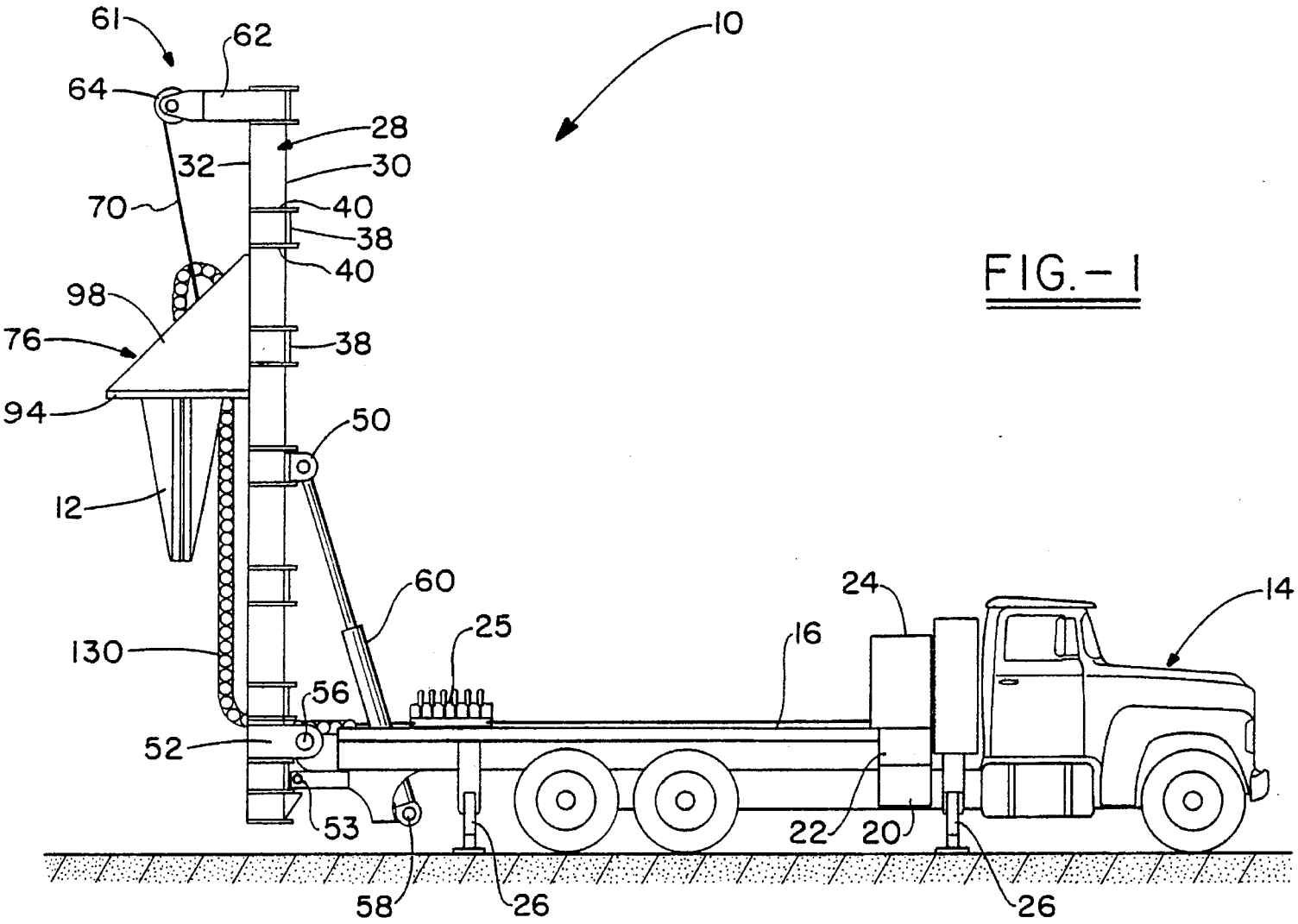
FIG. 1 is a side elevational view of an auger-thruster apparatus in accordance with the invention as it may be carried by a vehicle and positioned vertically for operation.
Figure 4:
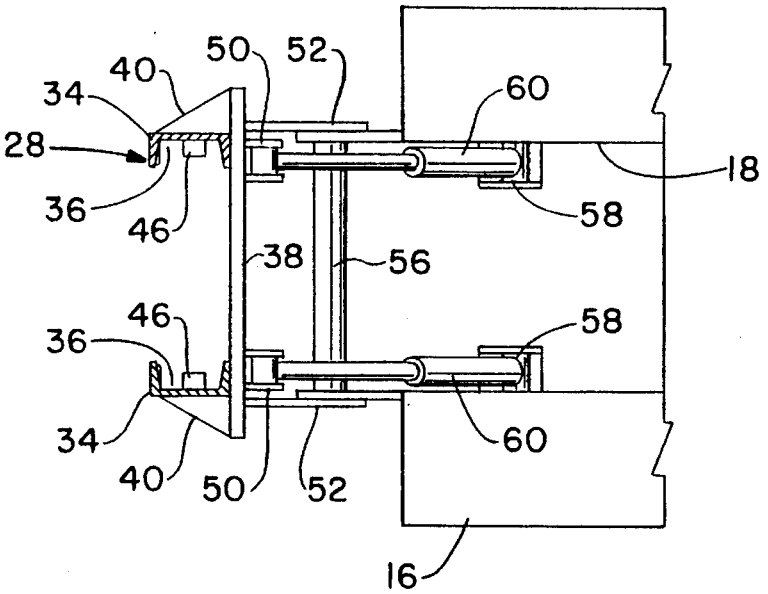
FIG. 4 is a top view of a rail track member broken away at the level of its piston connection and showing a small rear portion of the vehicle.

Referring now to the drawings and more particularly to FIG. 1, it can be seen that a machine for simultaneously augering and sinking an anchor is designated generally by the numeral 10. As shown, the machine 10 is carried and transported by an appropriate vehicle such as a truck 14. The truck 14 has a flatbed portion 16 supported thereon, with a thrust piston opening 18 disposed therein as shown in FIG. 4. Returning to FIG. 1, a hydraulic fluid reservoir 20, a motor 21, a hydraulic fluid pump 22, and a hydraulic fluid system 24 are affixed to the flatbed 16 of the vehicle 14. A hydraulic actuator 25 is disposed on the truck 14 and can be used to activate the hydraulic fluid system 24. It should be appreciated that the hydraulic actuator 25 can be electronically controlled by a remote signalling device if desired.

Hydraulic outriggers 26 are strategically located underneath and extend downwardly from the flatbed 16 to level and position the machine 10 so that the anchor 12, shown in FIG. 2 and to be discussed later herein, will be properly aligned when inserted into the ground. The outriggers 26 are controlled and manipulated by the hydraulic actuator 25.

Figure 6:
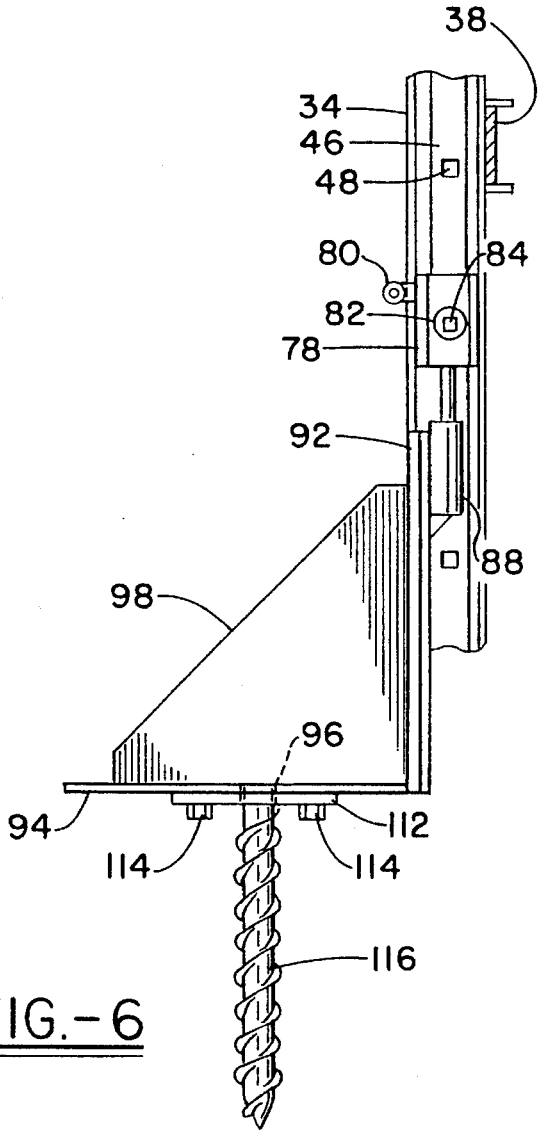
FIG. 6 is a side elevational view of the thruster platform shown in FIG. 5 with an auger mounted thereto and a portion of the rail track shown.

In its operating condition as shown in FIG. 1, the truck 14 carries a thrust rail track 28 shown in its vertical position. As shown in FIG. 1, the thrust rail track 28 has a support side 30 opposite an auger side 32. The thrust rail track 28 consists of two elongated channel shaped members 34 that are substantially parallel with each other as seen in FIGS. 2 and 4. Each channel shaped member 34 has a channel cavity 36, the cavities 36 of the channel shaped members 34 being diametrically opposed to each other. Sequentially spaced along the length of the channel shaped members 34 and welded thereto are a plurality of substantially perpendicular cross piece members 38 which overlap the channel members 34 on their support side 30. A plurality of gussets 40 are welded to interconnect the cross piece members 38 and the channel shaped members 34 to provide additional strength and support to the thrust rail track 28. Centrally disposed within each channel cavity 36 is an inner track 46. As best seen in FIG. 6, the inner tracks 46 have a plurality of sequentially spaced and oppositely disposed dog receiving holes 48.

As can be seen in FIG. 1, in order for the thrust rail track 28 to be elevated from its horizontal resting position upon the flatbed 16 to an upright and locked vertical position, several rotatably fixed interconnections therebetween are required. In particular, a plurality of thrust piston couplers 50 are disposed on the support side 30 of a centrally located cross piece member 38. Truck brackets 52 are disposed near the bottom outer side of each channel shaped member 34 in a diametrically opposed relationship. A rail track cross beam 56 is mounted underneath the flatbed 16 in such a manner that the truck brackets 52 are rotatably mounted upon the cross beam 56. A plurality of thrust piston base couplers 58 are received within the thrust piston opening 18 of the flatbed 16. A set of thrust pistons 60 are rotatably mounted to the thrust piston couplers 50 on the support side 30 of the thrust rail track 28 at one end and rotatably mounted to the thrust piston base couplers 58 at the opposite end. The thrust pistons 60 are operatively controlled by the hydraulic actuator 25 so that when activated, the thrust rail track 28 will pivot upwardly at the cross beam 56. To prevent the rail track 28 from over rotating, a panel 53 is secured to the bottom of the flat bed 16 and will abut the channel shaped members 34 when the rail track 28 is in the vertical position.

Figure 2:
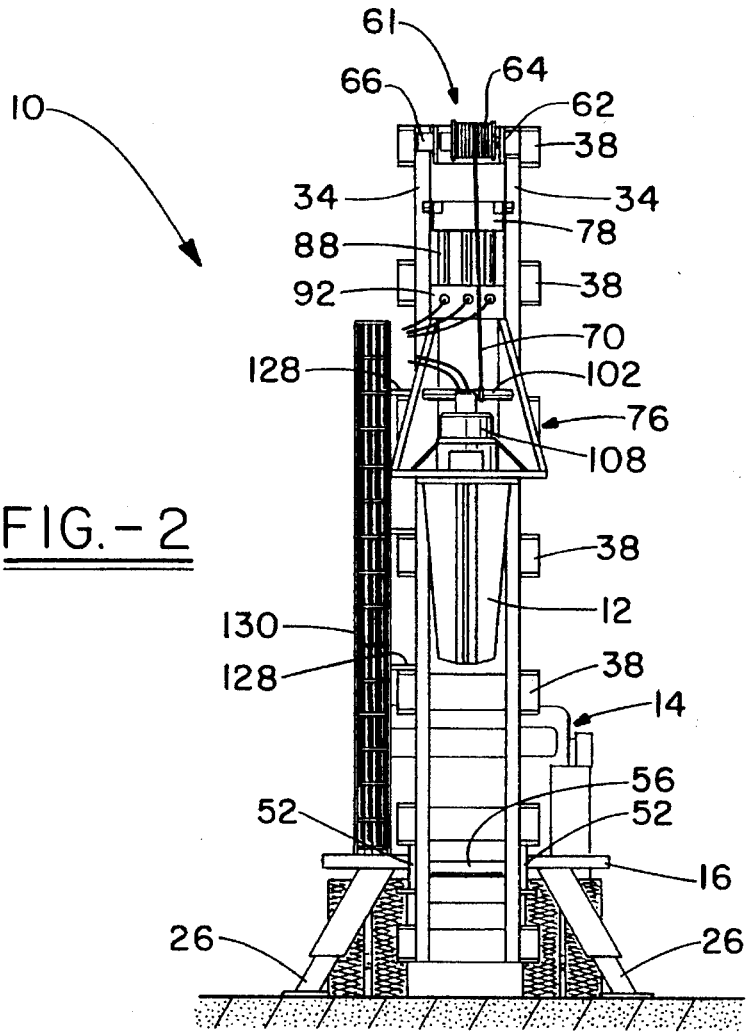
FIG. 2 is an elevational view of the apparatus shown in FIG. 1 as taken from the rear of the vehicle and apparatus.

A winch, generally designated by numeral 61 in FIG. 2, is shown at the top of the thrust rail track 28. As those skilled in the art will appreciate, a winch bracket 62 is securably mounted on the auger side 32 of the rail track 28, and is at the opposite end of the truck bracket 52. Rotatably mounted within the winch bracket 62, is a cable reel 64, which is operatively driven by a hydraulic winch motor 66. A hydraulic line is operatively connected to the hydraulic actuator 25 to drive the motor 66. A winch cable 70 is disposed around and controlled by the cable reel 64. The winch 61 is connected by the winch cable 70 to a platform, which is generally designated by numeral 76. The platform 76 is slidably engaged and is interleaved with the channel shaped members 34 and their inner tracks 46 and extends outwardly from the auger side 32.

Figure 5:
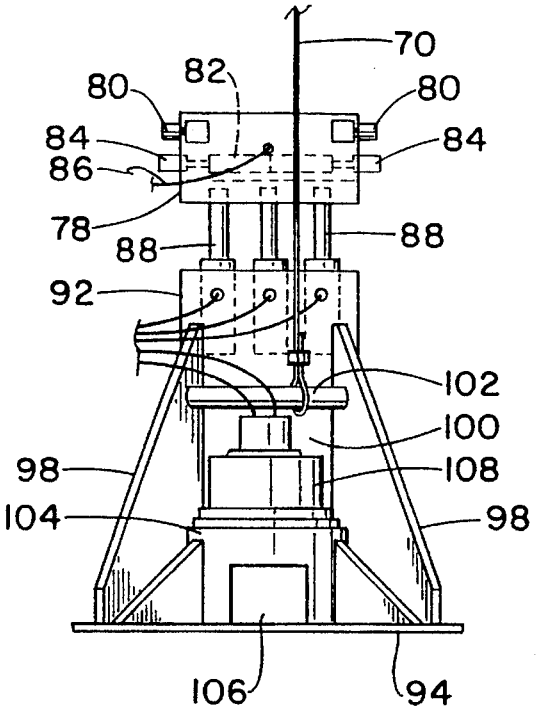
FIG. 5 is an elevational view of the thruster platform.

Further detail of the platform 76 is shown in FIGS. 5 and 6, where the upper portion of the platform 76 comprises a dog wall 78 that also is slidably engaged and interleaved with the channel members 34 and their inner tracks 46. To assist in retaining the dog wall 78 within the thrust rail track 28, a plurality of dog rollers 80 are securably mounted to the dog wall 78 and overlap the auger side 32 of the channel members 34. A dog piston 82 is disposed on the dog wall 78 to selectively engage a plurality of dogs 84 contained therein into the dog receiving holes 48 that are disposed within each inner track 46. The dog piston 82 is operatively driven by a hydraulic line 86 that is connected to the hydraulic actuator 25.

As further shown in FIGS. 2, 4, 5, and 6, a plurality of platform pistons 88 are operatively mounted to the dog wall 78 at one end and are operatively driven by a hydraulic line, which is also connected to the hydraulic control system 24. As those skilled in the art will appreciate at their opposite end, the platform pistons 88 are mountably connected to a platform wall 92, which is slidably engaged and interleaved with the channel members 34 and the inner tracks 46. The drawings illustrate the pistons 88 in their active or thrusting state. It should be appreciated that when the pistons 88 are closed, the dog wall 78 will abut the platform wall 92. Securably connected to the platform wall 92 is a platform base 94 that extends perpendicularly outward from the platform wall and also has an auger hole 96. A plurality of platform gussets 98 are securably mounted so as to interconnect the platform wall 92 to the platform base 94. The partially enclosed area formed by the platform wall 92, the platform base 94, and the plurality of platform gussets 98 form a platform cavity 100. A gusset bar 102 interconnects the gussets 98 to further stabilize the platform 76. Disposed within the cavity 100 and covering the auger hole 96 is an auger motor mount 104 which has a mount opening 106. Securably connected to the top of the auger motor mount 104 is an auger motor 108, which is connected to the hydraulic actuator 25 by a hydraulic line.

As best seen in FIG. 6, on the underside of the platform base 94 is an anchor holder 112 which is disposed around the auger hole 96. A plurality of holder latches 114 disposed around the anchor holder 112, serve to hold the anchor 12 in place during the drilling and thrusting operation. An auger 116 is operatively connected to the auger motor 108 and is concentrically disposed within the auger motor mount 104 and extends downwardly through the auger hole 96.

Figure 3:
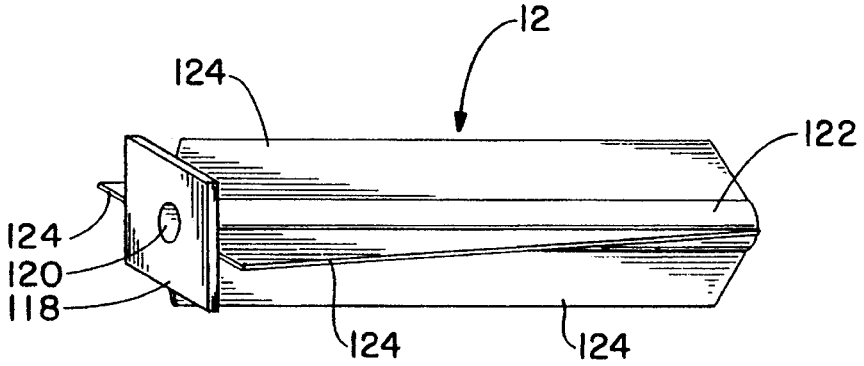
FIG. 3 is a perspective view of an anchor member forming an integral part of the apparatus.

Referring now to FIG. 3, those skilled in the art will appreciate that the anchor 12 is made up of a top plate 118 interconnected with an anchor tube 122. The top plate 118 has a plate hole 120 in communication with the central bore of the tube 122. Extending longitudinally outwardly from the tube 122 are a plurality of fins 124. The fins 124 provide lateral stability to the anchor 12 and preclude rotation thereof.

Referring back to FIG. 2, it can be seen that a plurality of support bars 128 outwardly extend from the outer side of one rail member 34. The support bars 128 have securably mounted thereto a support tray (not shown), which is used to hold a flexible carrier tray 130. The flexible carrier tray 130 will hold and retain the hydraulic lines going from the hydraulic actuator 25 to the hydraulic winch motor 66, the dog piston 82, the platform pistons 88, and the auger motor 108. The various hydraulic interconnections emanating from the hydraulic actuator 25 are illustrated in the schematic drawing of FIG. 7.

Figure 7:
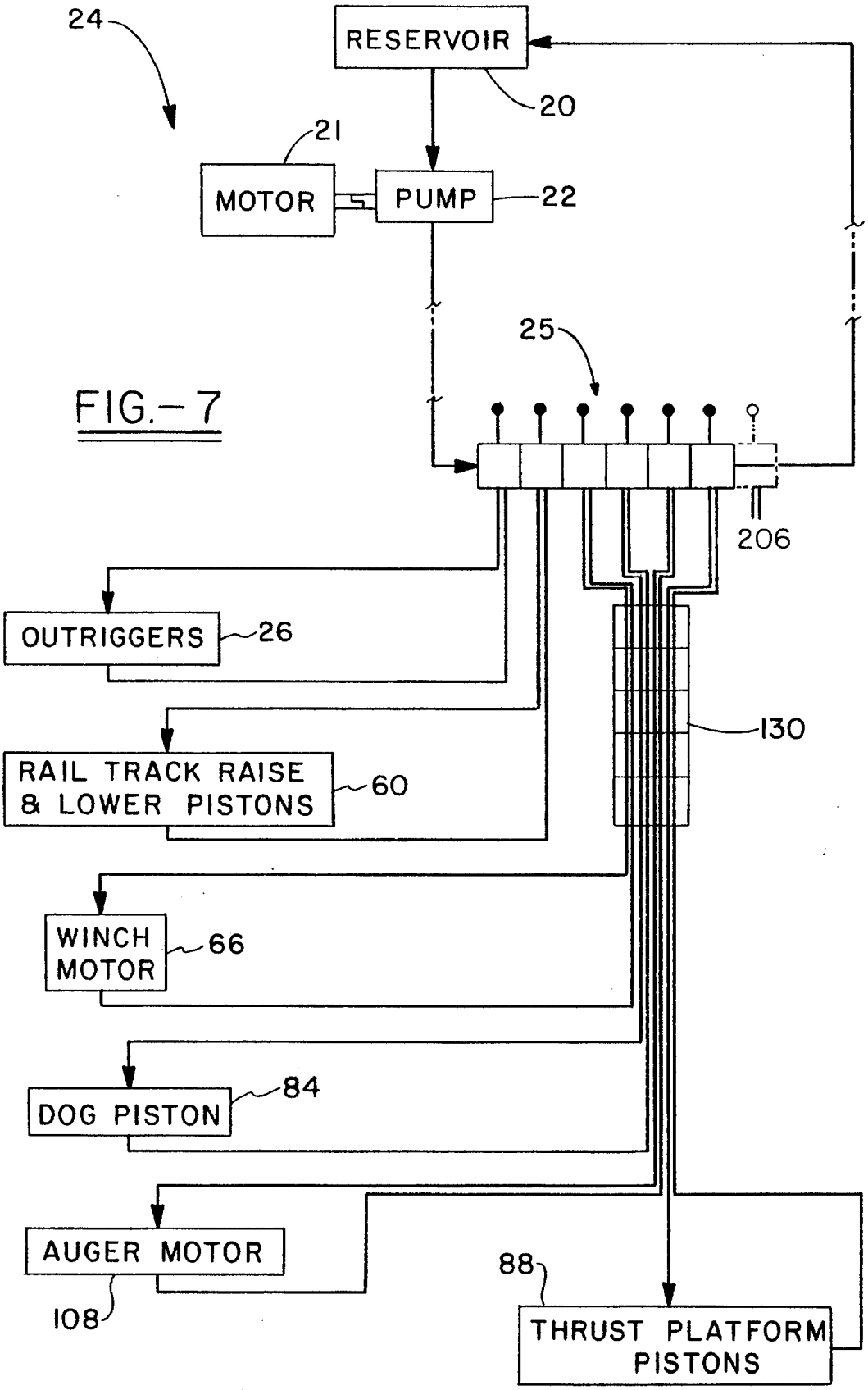
FIG. 7 diametrically illustrates the hydraulic control circuit of the invention.

In particular, FIG. 7 shows the hydraulic system 24, which is hydraulically controlled by the actuator system 25. The hydraulic fluid system 24 directly interconnects the hydraulic fluid reservoir 20, the motor 21 and the hydraulic fluid pump 22 so as to operate the functions of the machine 10. Specifically, the actuator 25 will direct hydraulic fluid from the reservoir 20 through the pump 22 to then actuate when the outriggers 26 are to be extended to level the truck 14, and when they are to be retracted. Likewise, the thrust pistons 60, for raising and lowering the thrust rail track 28, are controlled in a similar fashion. As can further be seen in the schematic drawing of FIG. 7, a flexible carrier tray 130 retains and protects the hydraulic lines, which serve to operate and control the winch motor 66, the dog piston 84, the auger motor 108 and the platform pistons 88 respectively. As those skilled in the art will appreciate, the flexible carrier tray 130 will prevent the hydraulic lines from becoming tangled as the platform 76 is raised and lowered into operation. Finally, it can be seen that the winch motor 66 and the auger motor 108 control the operation of the winch 61 and the auger 116 respectively.

Figure 8:
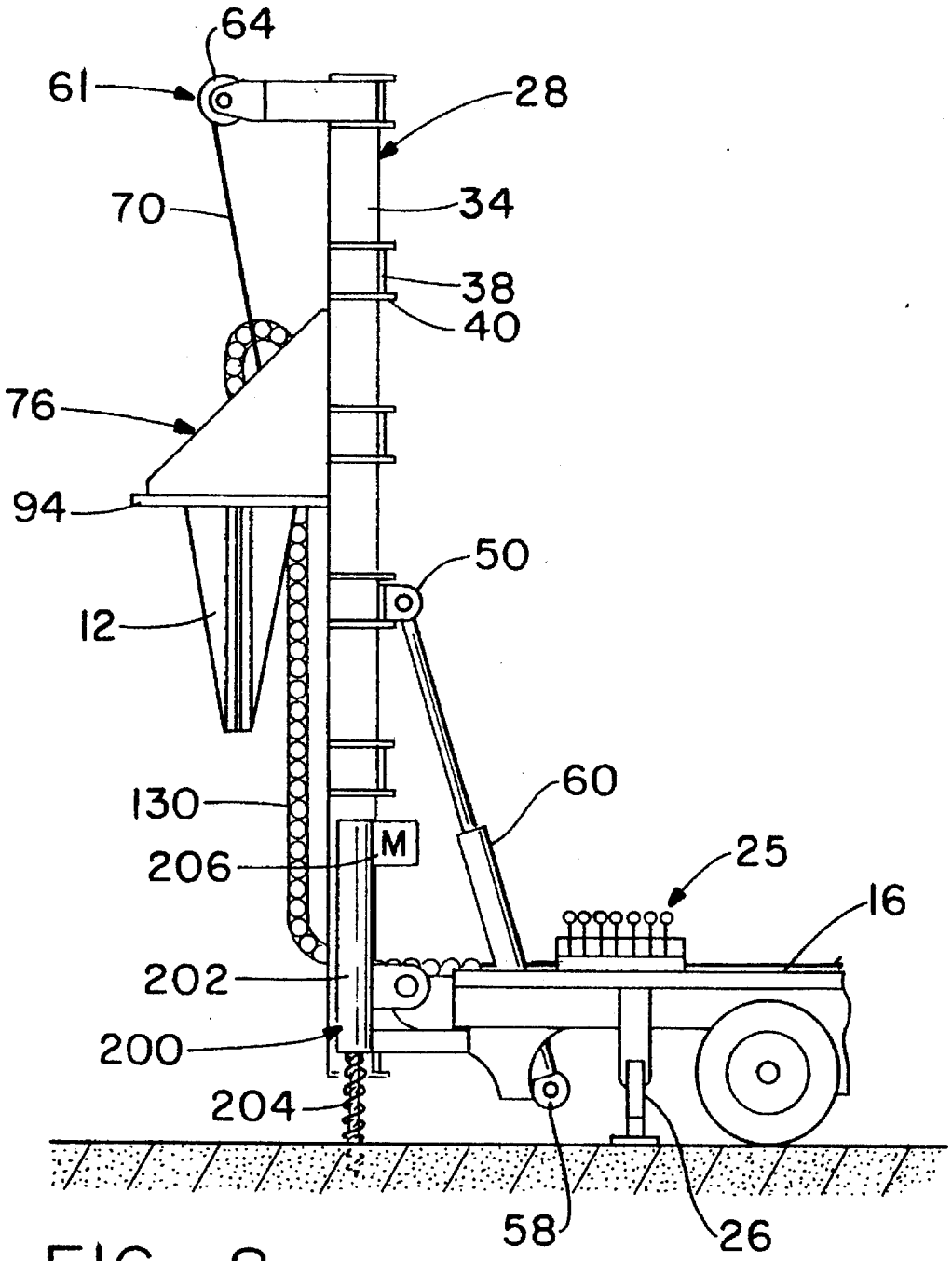
FIG. 8 is a side elevational view similar to FIG. 1 with the front portion of the vehicle broken away showing an embodiment of the apparatus utilizing an auger stabilizing means.

FIG. 8, a counter-thrust device generally designated by the Referring now to numeral 200, may be utilized to ensure that the anchor 12 is driven in a perpendicularly aligned manner with respect to the ground. The counter-thrust device 200 will include an auger tube 202 integrally mounted to the thrust rail track 28 and which has received therein an auger 204. An auger motor 206 is used to drive the auger 204 into the ground adjacent to where the anchor 12 is to be driven. It will be appreciated that the auger 204 will further secure and stabilize the vehicle 14 during the thrusting operation. Those skilled in the art will appreciate that other known methods of securing the vehicle 14 may be utilized such as affixing a counterweight in proximity to where the anchor 12 is to be driven or by use of anchoring pins.

Therefore, in actual operation, an engineering team will pick out various locations that they desire to place the anchors 12 for use with appropriate posts. The machine 10 will then drive to the various designated locations. If required, the counter-thrust device 200 will be activated to further secure the vehicle 14 before the thrusting procedure begins. The auger 204 is driven into the ground by the auger motor 206 into an area closely situated to where the anchor 12 is to be driven. The counter-thrust device 200 is especially useful in situations where the anchor receiving area is heavily compacted or likely to contain rocks. Otherwise, as will become apparent when the thrusting procedure is explained, the anchor 12 may be driven into the ground of an improper angle, thereby resulting in misaligned poles. As is presently known in the art, counterweights or anchoring pins also may be employed to stabilize the vehicle 14.

Once the truck 14 is driven into the proper position, the hydraulic fluid pump 22 and the hydraulic fluid system 24 are activated, and a series of tests are performed on the hydraulic lines to be sure that they are in the proper working order. The actuator 25 is then activated to set the outriggers 26 so that the truck 14 may be leveled and stabilized before the thrusting and drilling operations are to begin. Once the vehicle has been leveled, the platform 76 is locked into position on the thrust rail track 28. The anchor 12 is then placed by the operators into the anchor holder 112 and secured with the holder latches 114. The auger 116, which is detachable, is then inserted through the anchor 12 and attached to the auger motor 108 via the mount opening 106. The winch motor 66 is activated to tighten the winch cable 70 so that the platform 76 is held in a steady and locked position. The operator then engages the thrust pistons 60, which serve to pivot the thrust rail track 28 from a horizontal position on the flatbed 16 to an upright and locked vertical position, as shown in FIG. 1.

As best shown in FIGS. 2, 5 and 6, the dog piston 82, which is disposed on the dog wall 78, is then disengaged. The winch motor 66 is then activated to lower the platform 76, via the winch cable 70 to the lowest engageable position along the inner track 46 without the auger 116 touching the ground. The dog piston 82 is then reengaged so that the dogs 84 interlock with the dog receiving holes 48 that are disposed within the inner track 46. Accordingly, the winch motor 66 is deactivated so that the platform 76 may be driven. The platform pistons 88, which in the preferred embodiment will have a stroke of thirty-six inches, are then activated to push the platform wall 92 away from the dog wall 78 until the auger 116 is just above the ground. At that time, the operator starts the auger motor 108 and simultaneously engages the platform pistons 88 so that the anchor 12 is driven into the ground while the auger 116 removes the dirt and other materials from within the anchor tube 122, thereby facilitating the ease with which the anchor is placed into the ground. As those skilled in the art will appreciate, as the auger 116 pulls dirt up through the anchor tube 122, the dirt will be forced to exit out the mount opening 106, thereby preventing the dirt from interfering with the operation of the machine 10. Although removal of dirt by the auger 116 assists in sinking the anchor 12, the primary means of driving the anchor into the ground is provided by the platform pistons 88.

Once the platform pistons 88 have become fully stroked, the auger 116 is deactivated, and the platform pistons 88 are exhausted. The platform 76 along with the attached anchor 12, is then secured by the winch cable 70, and held in position. The dog piston 82 is then deactivated to release the dogs 84 from the dog receiving holes 48. The dog wall 78 is then lowered into the next engageable position along the inner track 46, while the pistons 88 retract accordingly. The dog piston 82 is then reactivated so that the dogs 84 re-secure the dog wall 78 in place. The platform pistons 88 and the auger 116 are then reactivated, while the winch motor 66 is deactivated, and the anchor 12 is further driven into the ground. This process of indexing the platform 76 downward to accommodate the stroke of the pistons 88 is repeated until the anchor 12 is fully set in the ground. Therefore, this indexing process provides a facile and reliable means of driving different size anchors into the ground.

Once the anchor 12 has been sunk, the holder latches 114 will be unlatched. The dog pistons 82 are then deactivated, and the winch motor 66 is activated so as to pull the platform 76 all the way up to the uppermost position along the thrust rail track 28. The dog piston 82 is then reactivated so as to lock the dogs 84 and thus the platform 76 into the inner track 46. The thrust pistons 60 are then deactivated so as to lower the thrust rail track 28 from its vertical position to a horizontal position along the flatbed 16. The outriggers 26 are next retracted, and the truck 14 is driven to the next job site where the operation described above will be repeated. The sunken anchor 12 is now ready to receive the desired utility pole or sign fixture required.

As those skilled in the art will appreciate, the present invention allows for the driving of anchors having various sizes and configurations. These different forms and configurations may appear so as to meet design requirements for the utility poles to be connected to the various anchors. For example, a long anchor with very wide fins would be used for a utility pole that is required to hold a light or sign high above the road surface. Likewise, a shorter anchor with small fins would be sufficient to support a utility or sign pole to be held at a lower level. It should therefore be apparent to those skilled in the art, that the objects of the present invention can be practiced with any size of anchor. While a preferred embodiment of the invention has been presented and described in detail, it will be understood that the invention is not limited thereto or thereby. Accordingly, for an appreciation of the true scope and breadth of the invention, reference should be made to the following claims.

Thus it can be seen that the objects of the invention have been satisfied by the structure presented above.

What is claimed is:

1. A combined auger and thruster machine for driving anchors into the ground, comprising:

a thrust rail track maintainable in a stationary position, said thrust rail track having a top, said thrust rail track having a pair of spaced apart channel members interconnected by a plurality of cross-piece members, each said channel member having a plurality of dog receiving holes;

a platform movable upon said thrust rail track, said platform having a dog wall assembly received by said channel members, said dog wall assembly having a dog piston to selectively engage a plurality of dogs that are received by said dog receiving holes, said platform having a platform wall, wherein said platform wall and said dog wall assembly are slidably interconnected by a plurality of pistons, said platform wall adaptable to receive an anchor, the anchor having an axial bore; and an auger carried by said platform and passing through the axial bore when the anchor is received by said platform, said plurality of pistons driving said platform with attached anchor and said auger when said plurality of dogs are received in said dog receiving holes.

2. A machine according to claim 1, further comprising a winch mounted to the top of said rail track and engaging said platform.

3. A machine according to claim 2, wherein a platform base extends from said platform wall, said platform base having an auger hole therethrough which is covered by an auger motor mount that has a mount opening, said auger carried by said auger motor mount, and wherein dirt exits said mount opening as said auger is turned and said platform is driven down.

4. A machine according to claim 3, further comprising a vehicle for transporting said machine; and wherein said vehicle is stabilized by a plurality of extendable outriggers.

5. A machine according to claim 4, further comprising means for moving said rail track between a horizontal and vertical position.

6. A machine according to claim 5, wherein a hydraulic system controls said means for moving said thrust rail track, said plurality of pistons, said auger, said winch, said dog piston, and said outriggers.

7. A machine according to claim 6, further comprising a remote signalling device to electronically actuate said hydraulic system.

8. A machine according to claim 7, wherein said anchor has a plurality of fins extending longitudinally therefrom, and a top plate that is receivable by said platform.

9. A combined auger and thruster machine, comprising:

a vehicle for transporting said machine, said vehicle is stabilized by a plurality of extendable outriggers;

a thrust rail track maintainable in a stationary position and means for moving said thrust rail track between a horizontal and vertical position said thrust rail track having a top and a plurality of opposed dog receiving holes;

a platform carried by said thrust rail track, said platform adapted to carry and drive an anchor, said anchor having an axial bore, said platform including a dog wall assembly having a dog disposed therein for selectively indexing said dog into said dog receiving holes, a platform wall drivingly connected to said dog wall assembly, a platform base securably connected to the bottom of said platform wall and perpendicularly extending outwardly therefrom, said platform base also secured to said platform wall by a plurality of gussets, said platform base having an auger hole, an auger motor securably attached to said auger motor mount, said auger drivingly connected to said auger motor and extending through said auger hole, a gusset bar securably interconnecting said gussets and receivingly connected to said winch cable, and an anchor holder disposed underneath said platform base for receiving said anchor;

a winch engaging said platform, said winch mountably secured to the top of said thrust rail track; and an auger carried by said platform and passing through the axial bore when said anchor is received by said platform.

10. A machine according to claim 9, wherein a hydraulic system controls said means for moving of said thrust rail track, said plurality of pistons, said auger, said winch, said dog wall assembly, and said outriggers.

11. A machine according to claim 10, further comprising a remote signalling device to electronically actuate said hydraulic system.

12. A machine according to claim 11 wherein said anchor has a plurality of fins extending longitudinally therefrom, and a top plate that is receivable by said platform.

13. A machine according to claim 12, wherein said winch comprises:

a winch motor;

a winch cable reel with a winch cable disposed thereon; said winch cable mountably connected to said platform.

14. A combined auger and thruster machine comprising:

a vehicle for transporting the machine;

a thrust rail track maintainable in a stationary position and which is movable from a horizontal to a vertical position, said thrust rail track having a top and a plurality of dog receiving holes;

a counter-thrust device mounted to said thrust rail track, said counter thrust device including a counter-thrust auger which is driven into the ground to stabilize said vehicle;

a dog wall movable upon said track, there being at least one dog piston disposed therein for selectively indexing a dog into said dog receiving hole;

a platform wall drivingly connected by a plurality of pistons below said dog wall and movable upon said track;

a platform base securably connected to the bottom of said platform wall and perpendicularly extending outwardly therefrom, said platform base also secured to said platform wall by a plurality of gussets, said gussets are interconnected by a gusset bar, said platform base having an auger hole;

a winch motor mountably secured to the top of said rail track drivingly operating a winch cable reel with a winch cable disposed thereon, said winch cable operatively connected to said bar, such that said winch motor can effectively raise and lower said platform;

an auger carried by said platform;

an auger motor mount disposed over said auger hole, said motor mount having a mount opening;

an auger motor securably attached to said auger motor mount, said auger drivingly connected to said auger motor and extending through said auger hole; and an anchor, said anchor having an axial bore such that said auger is received therein and said anchor is detachably mounted underneath said platform base said plurality of pistons driving said platform downwardly as said auger removes dirt from within said axial bore, the dirt exiting through said mount opening.

15. A machine according to claim 14, wherein said vehicle is stabilized by a plurality of extendable outriggers.

16. A machine according to claim 15, wherein a hydraulic system controls the operation of said thrust rail track, said driving force of said platform, said auger, said winch, said dog, and said outriggers.

17. A machine according to claim 16, wherein a remote signalling device is used to electronically actuate said hydraulic control system.

18. A machine according to claim 17, wherein said anchor has a plurality of fins extending longitudinally therefrom, and a top plate that is receivable by said platform.

* * * * *